US011413870B2

(12) United States Patent
Suzuki et al.

(10) Patent No.: US 11,413,870 B2
(45) Date of Patent: Aug. 16, 2022

(54) LIQUID EJECTING HEAD AND LIQUID EJECTING APPARATUS

(71) Applicant: SEIKO EPSON CORPORATION, Tokyo (JP)

(72) Inventors: Shigeki Suzuki, Shiojiri (JP); Noriaki Yamashita, Shiojiri (JP); Manabu Munakata, Matsumoto (JP); Shinichi Tsubota, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/152,476

(22) Filed: Jan. 19, 2021

(65) Prior Publication Data

US 2021/0221131 A1 Jul. 22, 2021

(30) Foreign Application Priority Data

Jan. 20, 2020 (JP) ..... JP2020-006666

(51) Int. Cl.
*B41J 2/14* (2006.01)
*B41J 2/165* (2006.01)
*B41J 2/21* (2006.01)

(52) U.S. Cl.
CPC ..... *B41J 2/1433* (2013.01); *B41J 2/16535* (2013.01); *B41J 2/2114* (2013.01)

(58) Field of Classification Search
None
See application file for complete search history.

(56) References Cited

U.S. PATENT DOCUMENTS 7,841,698 B2 * 11/2010 Sim ..... B41J 2/1628 347/47
2015/0202875 A1 * 7/2015 Watanabe ..... B41J 2/16538 347/33
2016/0185110 A1 * 6/2016 Masuda ..... B41J 2/04598 347/10
2016/0250858 A1 * 9/2016 Nakano ..... B41J 2/16535 347/31
2018/0304630 A1 * 10/2018 Okushima ..... B41J 2/14072

FOREIGN PATENT DOCUMENTS

JP H04-214358 8/1992
JP 2006-334910 12/2006
JP 2010-264696 11/2010
JP 2016-196125 11/2016

* cited by examiner

*Primary Examiner* — Alejandro Valencia
(74) *Attorney, Agent, or Firm* — Workman Nydegger

(57) ABSTRACT

A liquid ejecting head includes first nozzles configured to eject a liquid in an ejecting direction, a first nozzle forming surface in which openings of the first nozzles are formed, a first surface being adjacent to the first nozzle forming surface when viewed in an opposite direction to the ejecting direction and provided in the ejecting direction relative to the first nozzle forming surface, and a first film member having water repellency on a surface directed to the ejecting direction and being detachably provided to the first surface in such a way as to expose the first nozzle forming surface in the ejecting direction.

19 Claims, 10 Drawing Sheets

LIQUID EJECTING HEAD AND LIQUID EJECTING APPARATUS

The present application is based on, and claims priority from JP Application Serial Number 2020-006666, filed Jan. 20, 2020, the disclosure of which is hereby incorporated by reference herein in its entirety.

BACKGROUND

1. Technical Field

The present disclosure relates to a liquid ejecting head and a liquid ejecting apparatus.

2. Related Art

There has heretofore been proposed a liquid ejecting apparatus that carries liquid ejecting heads each configured to eject a liquid such as an ink from nozzles therein. For example, JP-A-2010-264696 discloses a technique of subjecting an ejecting surface to a water-repellent treatment in order to improve a wiping performance when wiping off a liquid adhering to the ejecting surface.

The liquid ejecting apparatus disclosed in JP-A-2010-264696 is prone to deterioration of the ejecting surface subjected to the water-repellent treatment due to repetition of wiping operations.

SUMMARY

To solve this problem, according to an aspect of the present disclosure, there is provided a liquid ejecting head which includes first nozzles that eject a liquid in an ejecting direction, a first nozzle forming surface in which openings of the first nozzles are formed, a first surface being adjacent to the first nozzle forming surface in view of an opposite direction to the ejecting direction and provided in the ejecting direction relative to the first nozzle forming surface, and a first film member having water repellency on a surface directed to the ejecting direction and being detachably provided to the first surface in such a way as to expose the first nozzle forming surface in the ejecting direction.

DESCRIPTION OF EXEMPLARY EMBODIMENTS

A: FIRST EMBODIMENT

Figure 1:
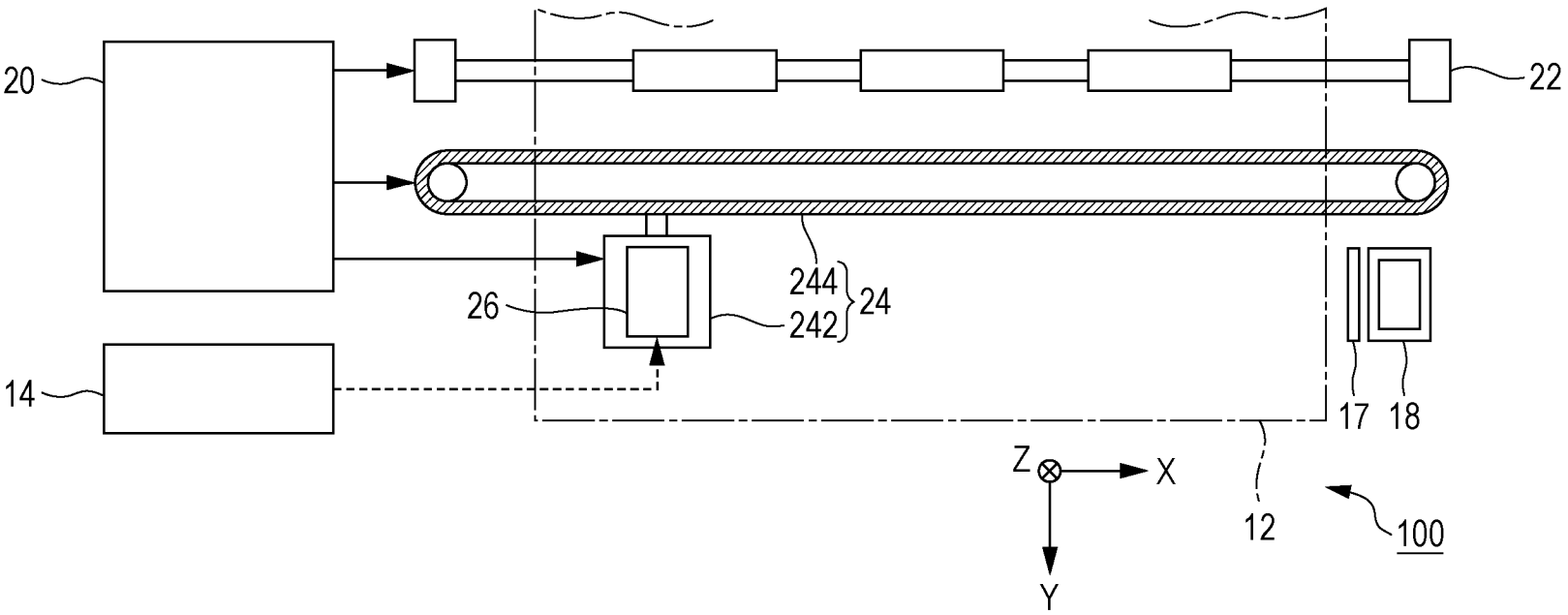
FIG. 1 is a schematic diagram showing a configuration example of a liquid ejecting apparatus according to a first embodiment of the present disclosure.

FIG. 1 is a schematic diagram showing a configuration example a liquid ejecting apparatus 100 according to a first embodiment of the present disclosure. The liquid ejecting apparatus 100 of the first embodiment is an ink jet printing apparatus configured to eject an ink representing an example of a liquid onto a medium 12. While the medium 12 is typically printing paper, a printing object made of an arbitrary material such as a resin film and a fabric may also be used as the medium 12.

As shown in FIG. 1, the liquid ejecting apparatus 100 is provided with a liquid container 14 that stores inks. For example, a cartridge attachable to and detachable from the liquid ejecting apparatus 100, an ink package in the form of a bag made of a flexible film, or an ink-refillable ink tank is used as the liquid container 14.

The liquid ejecting apparatus 100 includes a control unit 20, a transport mechanism 22, a movement mechanism 24, and a liquid ejecting head 26 as shown in FIG. 1. The control unit 20 includes a processing circuit such as a central processing unit (CPU) and a field programmable gate array (FPGA) and a storage circuit such as a semiconductor memory, and performs overall control of elements in the liquid ejecting apparatus 100. The transport mechanism 22 transports the medium 12 in a direction of a Y-axis under the control of the control unit 20.

The movement mechanism 24 reciprocates the liquid ejecting head 26 along an X-axis under the control of the control unit 20. The X-axis is an axis that is orthogonal to the Y-axis extending along the direction of transport of the medium 12. The movement mechanism 24 includes a transport body 242 substantially in a box shape to house the liquid ejecting head 26, and a transport belt 244 to which the transport body 242 is fixed. Here, a configuration in which two or more liquid ejecting heads 26 are mounted on the transport body 242 or a configuration in which the liquid container 14 is mounted on the transport body 242 together with the liquid ejecting head 26 is also adoptable. The transport body 242 is a carriage, for instance.

The liquid ejecting head 26 ejects the inks, which are supplied from the liquid container 14, from nozzles N onto the medium 12 under the control of the control unit 20. The nozzles N are arranged in the direction of the Y-axis. In the liquid ejecting apparatus 100, an intended image is formed on a surface of the medium 12 by ejection of the inks from the liquid ejecting head 26 onto the medium 12 in parallel with transport of the medium 12 by the transport mechanism 22 and repeated reciprocation of the transport body 242.

As shown in FIG. 1, the liquid ejecting apparatus 100 includes a wiping member 17 and a cap 18. To be more precise, the wiping member 17 and the cap 18 are disposed so as to face an ejecting surface on a positive direction (an ejecting direction) side of a Z-axis of the liquid ejecting head 26 in a state of being located at a position not opposed to the medium 12. The positive direction of the Z-axis (a first direction) is a direction that the liquid ejecting head 26 ejects the inks. The ejecting surface is a surface provided with the nozzles N serving as ejecting holes to eject the liquid, details of which will be described later.

The wiping member 17 is a wiper that wipes the ejecting surface of the liquid ejecting head 26. In the first embodiment, the wiping member 17 comes into contact with the ejecting surface in the process of movement of the liquid ejecting head 26 along the direction of the X-axis. Thus, the ejecting surface is wiped by the wiping member 17. In other words, as shown in FIG. 2B, the wiping member 17 wipes the ejecting surface of the liquid ejecting head 26 along a direction (the direction of the X-axis) orthogonal to a direction of arrangement of the nozzles N. The wiping member 17 is formed from an elastomer or a cloth, for example. However, the material of the wiping member 17 is not limited to the aforementioned examples. Meanwhile, the wiping member 17 may be configured to perform a wiping operation by moving relative to the liquid ejecting head 26.

The cap 18 has a recessed shape which is open on one side opposed to the ejecting surface. The cap 18 is a sealing body which causes its tip end on the positive direction side of the Z-axis to abut on an after-mentioned abutting surface T provided to the ejecting surface, and thus forms a closed space defined by the ejecting surface and the recessed form inside the cap 18, thereby sealing the respective nozzles N. The tip end of the cap 18 that abuts on the abutting surface T is formed from an elastic body, for example. The inks are forcibly discharged from the nozzles N by reducing a pressure of the space inside the cap 18 in the state where the ejecting surface is sealed with the cap 18.

Figure 2A:
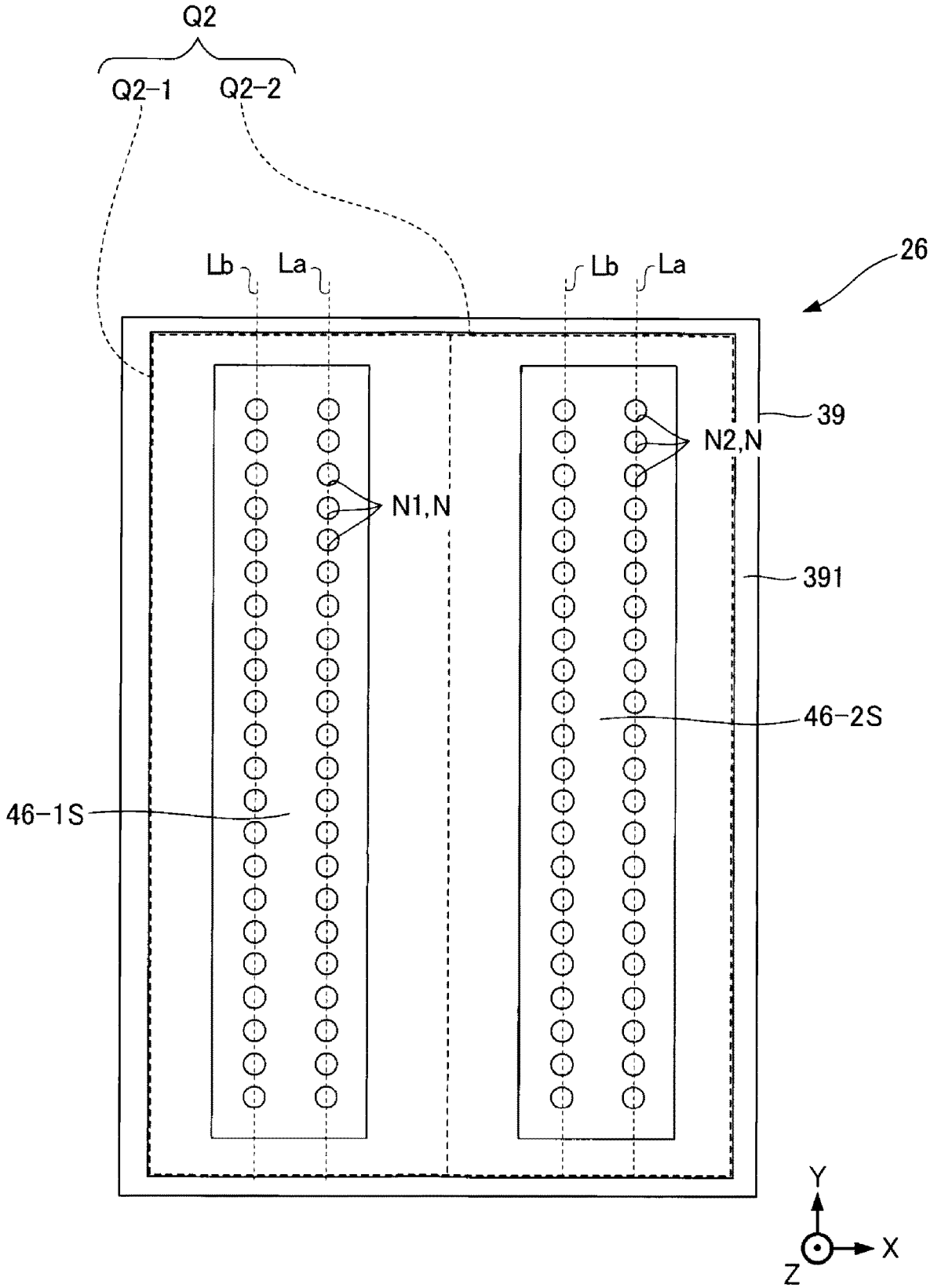
FIG. 2A is a schematic diagram of the liquid ejecting head viewed from an opposite direction to an ejecting direction.
Figure 2B:
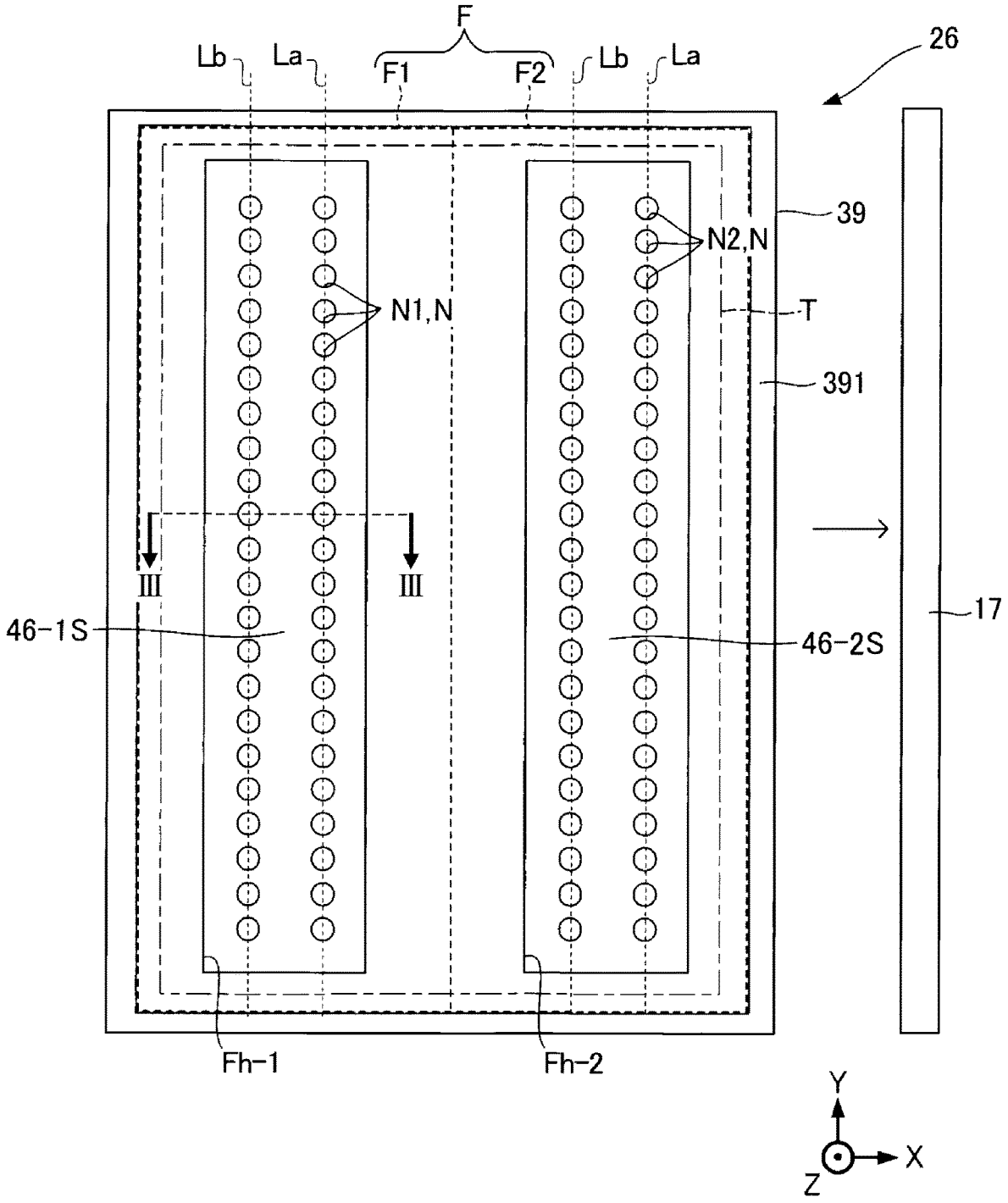
FIG. 2B is another schematic diagram of the liquid ejecting head viewed from the opposite direction to the ejecting direction.
Figure 3:
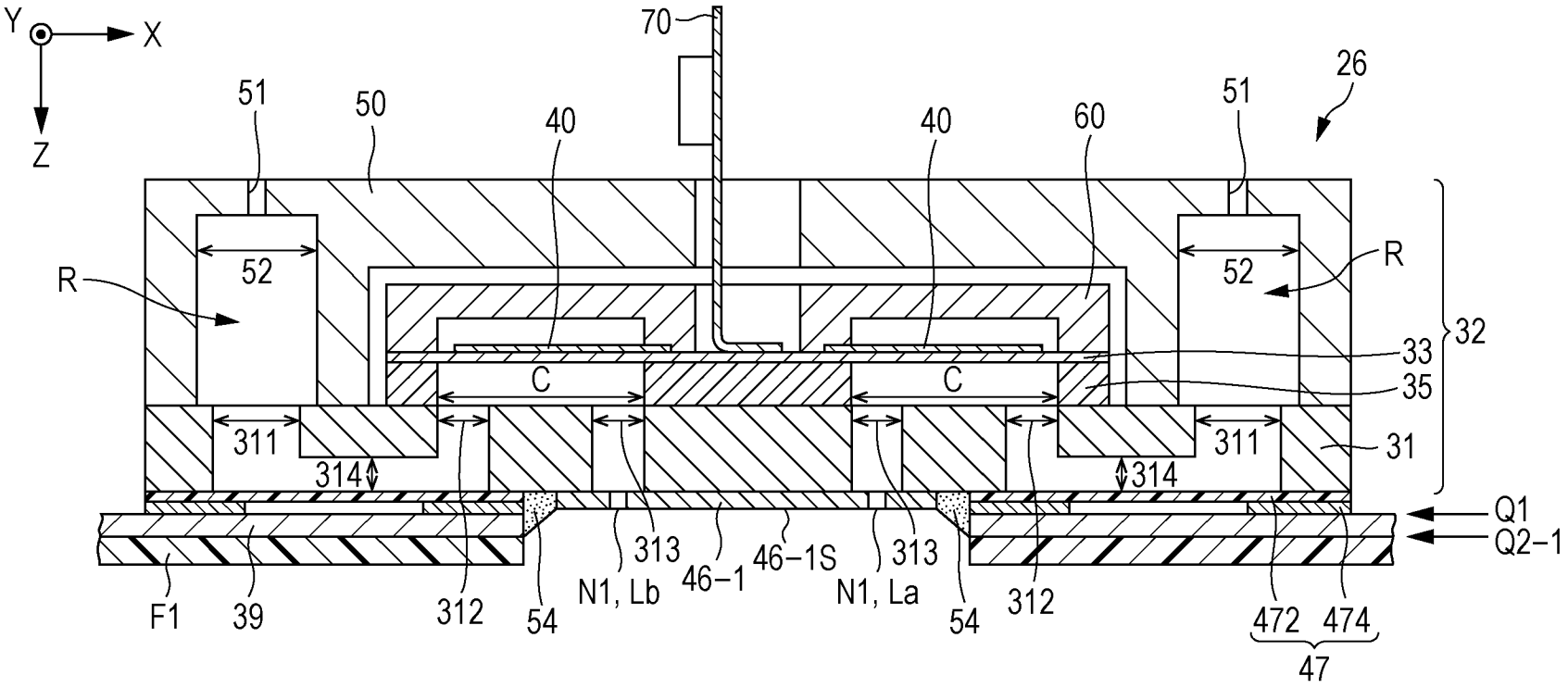
FIG. 3 is a cross-sectional view taken along line III-III in FIG. 2B.

FIGS. 2A and 2B are schematic diagrams of the liquid ejecting head 26 viewed in a negative direction of the Z-axis, and FIG. 3 is a cross-sectional view of the liquid ejecting head 26 taken along line III-III in FIG. 2B. As shown in FIGS. 2A and 2B, the Z-axis is assumed to be perpendicular to an X-Y plane. The cross-section of the liquid ejecting head 26 shown in FIG. 3 is a cross-section perpendicular to the Y-axis. Note that illustration of a water-repellent film F to be described later is omitted in FIG. 2A. Moreover, illustration of a filler 54 to be described later is omitted in FIGS. 2A and 2B. The directions of the X, Y, and Z axes indicated in FIGS. 2A and 2B represent directions of three axes that are orthogonal to one another. The same applies to all of the drawings illustrated in this application.

As shown in FIGS. 2A and 2B, the ejecting surface of the liquid ejecting head 26 is provided with the nozzles N. The ejecting surface of the liquid ejecting head 26 includes a first nozzle forming surface 46-1S, a second nozzle forming surface 46-2S, and a surface of the water-repellent film F to be described later. The nozzles N include first nozzles N1 and second nozzles N2. The first nozzles N1 form a first row La and a second row Lb each being a row of nozzles in which the first nozzles N1 are arranged along the Y-axis. The first row La and the second row Lb are arranged in parallel along the X-axis. Likewise, the second nozzles N2 form a first row La and second row Lb each being a row of nozzles in which the second nozzles N2 are arranged along the Y-axis. The first row La and the second row Lb of the first nozzles N1 and the first row La and the second row Lb of the second nozzles N2 are juxtaposed to one another with intervals in the direction of the X-axis.

The first nozzles N1 are divided into the first row La and the second row Lb. Each of the first row La and the second row Lb is an aggregate of the first nozzles N1 that are arranged in the direction of the Y-axis. The first row La and the second row Lb are juxtaposed to each other at an interval in the direction of the X-axis. The following description will exemplify the case where the respective first nozzles N1 on the first row La and the respective first nozzles N1 on the second row Lb share the same locations on the Y-axis for convenience sake. Instead, the locations on the Y-axis of the respective first nozzles N1 on the first row La may be displaced from the locations on the Y-axis of the respective first nozzles N1 on the second row Lb. In other words, the first nozzles N1 may be arranged in a staggered manner. While the above-described configuration involves the first nozzles N1, the same applies to the second nozzles N2 as well.

Each of the first nozzles N1 ejects a first ink. Each of the second nozzles N2 ejects a second ink. The first ink and the second ink are pigment inks each containing a pigment as its coloring material, for example. The Mohs hardness of pigment particles contained in the first ink is larger than the Mohs hardness of pigment particles contained in the second ink. The first ink is an example of a "first liquid" and the second ink is an example of a "second liquid". Here, the liquids ejected from the first nozzles N1 and the second nozzles N2 may be the same liquid.

Figure 4:
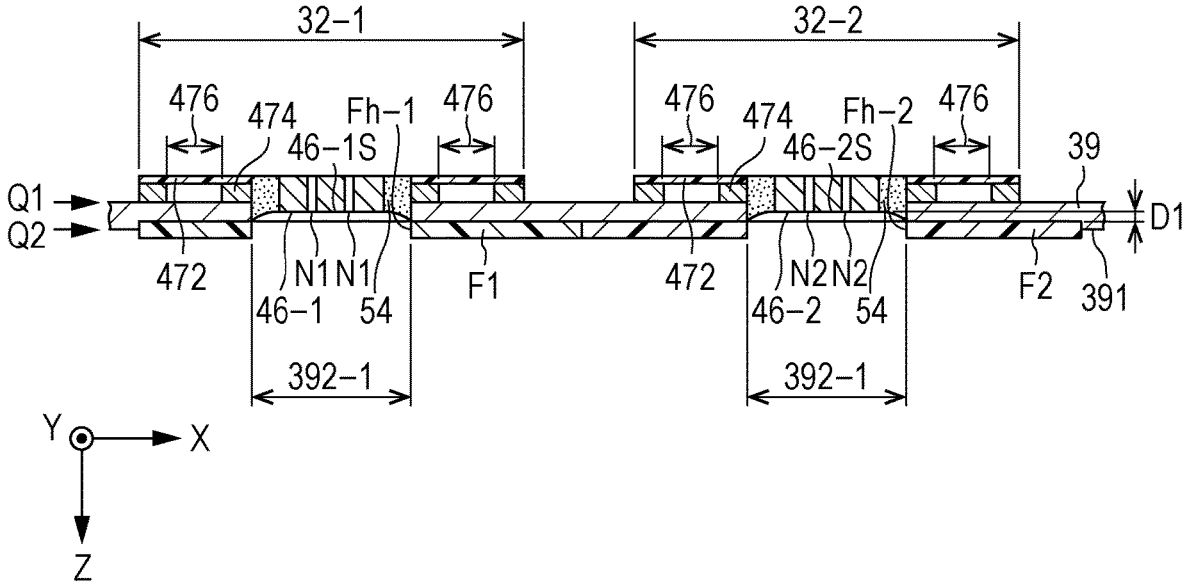
FIG. 4 is a cross-sectional view for explaining a relation between a fixing plate and each liquid ejecting unit.

As shown in FIG. 4, the liquid ejecting head 26 includes a liquid ejecting unit 32-1, a liquid ejecting unit 32-2, a fixing plate 39, and the water-repellent film F. These liquid ejecting units 32 are fixed to the fixing plate 39. The first nozzles N1 are formed in the liquid ejecting unit 32-1 and the second nozzles N2 are formed in the liquid ejecting unit 32-2. In the following description, each of the liquid ejecting unit 32-1 and the liquid ejecting unit 32-2 will be simply referred to as the "liquid ejecting unit 32" when the distinction is not necessary. Likewise, each set of the first nozzles N1 and the second nozzles N2 will be simply referred to as the "nozzles N" when the distinction is not necessary.

The liquid ejecting units 32 are head chips that eject the liquids from the nozzles N. Each liquid ejecting unit 32 is a structure in which elements related to the first row La and elements related to the second row Lb are plane-symmetrically formed with respect to a symmetrical plane that is parallel to a Y-Z plane.

The liquid ejecting unit 32-1 includes a flow channel substrate 31, a pressure chamber substrate 35, a vibrating plate 33, a nozzle plate 46-1, and a compliance unit 47. These components are plate members which are elongate in the direction of the Y-axis. The pressure chamber substrate 35 and a housing unit 50 are provided on a surface of the flow channel substrate 31 directed to the negative direction of the Z-axis. The nozzle plate 46-1 and the compliance unit 47 are provided on a surface of the flow channel substrate 31 directed to a positive direction of the Z-axis. The respective components constituting the liquid ejecting unit 32-1 are fixed to one another by using an adhesive, for example.

The nozzle plate 46-1 is a plate member provided with the first nozzles N1 that form the first row La and the second row Lb. Each of the first nozzles N1 is a circular through hole configured to eject the ink. As shown in FIGS. 2A and 2B, the nozzle plate 46-1 includes the first nozzle forming surface 46-1S in which openings of the first nozzles N1 are formed. The first nozzle forming surface 46-1S is subjected to a prescribed water-repellent treatment in light of favorably forming a meniscus of the ink ejected from each first nozzle N1. In this case, a configuration may be adopted in which the water-repellent treatment is carried out while providing a desired foundation layer to the first nozzle forming surface 46-1S. This specification defines the "water repellency" as a state where a solid surface is in contact with a liquid and a gas and a contact angle being an angle defined by a liquid surface and a solid surface at a boundary line of contact of these three phases is equal to or above 90°.

The liquid ejecting unit 32-2 includes the flow channel substrate 31, the pressure chamber substrate 35, the vibrating plate 33, a nozzle plate 46-2, and the compliance unit 47. These components are plate members which are elongate in the direction of the Y-axis. The pressure chamber substrate 35 and the housing unit 50 are provided on the surface of the flow channel substrate 31 directed to the negative direction of the Z-axis. The nozzle plate 46-2 and the compliance unit 47 are provided on another surface of the flow channel substrate 31 directed to the positive direction of the Z-axis. The respective components constituting the liquid ejecting unit 32-2 are fixed to one another by using an adhesive, for example.

The nozzle plate 46-2 is a plate member provided with the second nozzles N2 that form the first row La and the second row Lb. Each of the second nozzles N2 is a circular through hole configured to eject the ink. As shown in FIGS. 2A and 2B, the nozzle plate 46-2 includes the second nozzle forming surface 46-2S in which openings of the second nozzles N2 are formed. The second nozzle forming surface 46-2S is subjected to the prescribed water-repellent treatment in light of favorably forming a meniscus of the ink ejected from each second nozzles N2. In this case, a configuration may be adopted in which the water-repellent treatment is carried out while providing a desired foundation layer to the second nozzle forming surface 46-2S. In the following description, each of the nozzle plate 46-1 and the nozzle plate 46-2 will be simply referred to as the "nozzle plate 46" when the distinction is not necessary. Likewise, each of the first nozzle forming surface 46-1S and the second nozzle forming surface 46-2S will be simply referred to as the "nozzle forming surface 46S" when the distinction is not necessary.

For example, the nozzle plate 46 is manufactured by processing a silicon (Si) single crystal substrate by means of photolithography, etching, and the like. However, other publicly known materials and manufacturing methods may be adopted to manufacture the nozzle plate 46 as appropriate.

As shown in FIG. 3, the flow channel substrate 31 includes first spaces 311, supply flow channels 312, communication flow channels 313, and relay flow channels 314. Each first space 311 is an opening that is formed into an elongate shape along the direction of the Y-axis in view of the direction of the Z-axis.

Each supply flow channel 312 and each communication flow channel 313 are through holes formed for each nozzle N. Each relay flow channel 314 is a space formed into an elongate shape along the direction of the Y-axis across the nozzles N. The relay flow channel 314 establishes communication between the first spaces 311 and the supply flow channels 312. Each of the communication flow channels 313 overlaps the nozzle N corresponding to the relevant communication flow channel 313 in plan view.

As shown in FIG. 3, the pressure chamber substrate 35 is provided with pressure chambers C. Each pressure chamber C is a space in an elongate shape along the direction of the X-axis in view of the direction of the Z-axis, which is formed for each nozzle N. The pressure chambers C are arranged along the direction of the Y-axis.

As with the above-mentioned nozzle plate 46, each of the flow channel substrate 31 and the pressure chamber substrate 35 is manufactured by processing a silicon single crystal substrate by means of photolithography, etching, and the like. However, other publicly known materials and manufacturing methods may be adopted to manufacture any of the flow channel substrate 31 and the pressure chamber substrate 35 as appropriate.

As shown in FIG. 3, the elastically deformable vibrating plate 33 is provided to a surface of a pressure chamber substrate 25 on the opposite side to a surface provided with the flow channel substrate 31. The vibrating plate 33 is a plate member having a rectangular shape that is elongate in the direction of the Y-axis in view of the direction of the Z-axis.

As shown in FIG. 3, each pressure chamber C is the space located between the flow channel substrate 31 and the vibrating plate 33. The vibrating plate 33 forms a wall surface of each pressure chamber C. As shown in FIG. 3, the pressure chamber C communicates with the communication flow channel 313 and the supply flow channel 312. Accordingly, the pressure chamber C communicates with the nozzle N through the communication flow channel 313 and with a liquid storage chamber R through the supply flow channel 312 and the relay flow channel 314.

As shown in FIG. 3, the housing unit 50 is a case for storing the inks to be supplied to the pressure chambers C. The housing unit 50 is formed by injection molding of a resin material, for example. The housing unit 50 is provided with an inlet port 51 and a second space 52. The inlet port 51 is a pipe line that supplies the ink from the liquid container 14 and communicates with the second space 52.

The first space 311 in the flow channel substrate 31 and the second space 52 in the housing unit 50 communicate with each other as shown in FIG. 3. A space defined by the first space 311 and the second space 52 functions as the liquid storage chamber R to store the ink to be supplied to the pressure chambers C.

The ink that is supplied from the liquid container 14 and passed through the inlet port 51 is stored in the liquid storage chamber R. The ink stored in the liquid storage chamber R is branched off from the relay flow channel 314 into the supply flow channels 312, and is supplied to the pressure chambers C in parallel and fills the pressure chambers C.

The compliance unit 47 is a vibration absorber that absorbs pressure variations inside the liquid storage chamber R. The compliance unit 47 includes an elastic film 472 and a support plate 474. The elastic film 472 is a flexible film that forms a wall surface of the liquid storage chamber R and is configured to absorb the pressure variations inside the liquid storage chamber R. To be more precise, the wall surface is a bottom surface of the liquid storage chamber R. The support plate 474 is a flat plate member made of a highly rigid material such as stainless steel.

The support plate 474 supports the elastic film 472 with the surface of the flow channel substrate 31 so as to block the first space 311 of the flow channel substrate 31 with the elastic film 472. A region of the support plate 474 that overlaps the liquid storage chamber R while interposing the elastic film 472 in between is provided with an opening 476.

As shown in FIG. 3, a piezoelectric element 40 is formed for each pressure chamber C on a surface of the vibrating plate 33 located on the opposite side of the pressure chamber C. Each piezoelectric element 40 is a passive element having an elongate shape extending along the direction of the X-axis in view of the direction of the Z-axis. The piezoelectric elements 40 are arranged along the direction of the Y-axis.

Each of the piezoelectric elements 40 is deformed in response to an applied voltage, thereby changing the pressure inside the pressure chamber C. As the piezoelectric element 40 changes the pressure inside the pressure chamber C, the ink inside the pressure chamber C is ejected from the nozzle N.

A sealing body 60 is a structure configured to protect the piezoelectric elements 40 and to reinforce mechanical strengths of the pressure chamber substrate 35 and the vibrating plate 33. The sealing body 60 is fixed to the surface of the vibrating plate 33 with an adhesive, for example. The sealing body 60 is manufactured by processing a silicon single crystal substrate by using general semiconductor manufacturing techniques, for example.

A wiring substrate 70 is joined to the surface of the vibrating plate 33. The wiring substrate 70 is a mounted component provided with lines for electrically coupling the control unit 20 to the liquid ejecting head 26. Illustration of the lines is omitted in FIG. 3. A flexible substrate such as a flexible printed circuit (FPC) substrate and a flexible flat cable (FFC) substrate can be suitably applied to the wiring substrate 70. The wiring substrate 70 supplies driving signals for driving the piezoelectric elements 40 and a prescribed reference voltage to the respective piezoelectric elements 40.

FIG. 4 is a cross-sectional view for explaining a relation between the fixing plate 39 and each liquid ejecting unit 32. The fixing plate 39 is a plate member having a surface Q1 and a surface Q2. The surface Q1 is a surface on the opposite side of the surface Q2. The liquid ejecting unit 32-1 and the liquid ejecting unit 32-2 are fixed to the surface Q1 of the fixing plate 39 with an adhesive, for example. As shown in FIG. 4, a distance D1 between the nozzle forming surface 46S and the surface Q2 is larger than a thickness of the water-repellent film F in the direction of the Z-axis. To be more precise, the distance D1 may be equal to 0.07 mm or 0.09 mm. Meanwhile, a width of an opening 392 in the direction of the X-axis is equal to 2.2 mm, for example.

As shown in FIG. 4, the fixing plate 39 is provided with an opening 392-1 and an opening 392-2 which correspond to the liquid ejecting unit 32-1 and the liquid ejecting unit 32-2, respectively. The opening 392-1 and the opening 392-2 are through holes arranged in the direction of the X-axis at a given interval in between. In the following description, each of the opening 392-1 and the opening 392-2 will be simply referred to as the "opening 392" when the distinction is not necessary. As shown in FIG. 4, each liquid ejecting unit 32 is fixed to the surface Q1 of the fixing plate 39 while locating the nozzle plate 46 inside each opening 392.

The opening 392-1 formed in the fixing plate 39 is a through hole for exposing the first nozzles N1 of the respective liquid ejecting units 32. Likewise, the opening 392-2 formed in the fixing plate 39 is a through hole for exposing the second nozzles N2 of the respective liquid ejecting units 32. As shown in FIG. 4, the inside of the opening 392 is filled with the filler 54. The filler 54 is made of a resin material, for example. By filling the inside of the opening 392 with the filler 54, the ink is kept from infiltrating and remaining in a gap between the nozzle plate 46 and the compliance unit 47 or a gap between the nozzle plate 46 and the fixing plate 39.

As shown in FIG. 4, the surface Q2 is located in the positive direction of the Z-axis relative to the nozzle forming surface 46S. As shown in FIG. 2A, the surface Q2 includes a surface Q2-1 which is located adjacent to the first nozzle forming surface 46-1S in view of the direction of the Z-axis and surrounds the first nozzle forming surface 46-1S about the Z-axis, and a surface Q2-2 which is located adjacent to the second nozzle forming surface 46-2S in view of the direction of the Z-axis and surrounds the second nozzle forming surface 46-2S about the Z-axis. Dashed lines in FIG. 2A represent the surface Q2-1 and the surface Q2-2. The first nozzle forming surface 46-1S and the second nozzle forming surface 46-2S are provided side by side in the direction along the X-axis. In the meantime, the surface Q2-1 and the surface Q2-2 are the surfaces that are provided side by side in the direction along the X-axis and are continuous with each other. The surface Q2 is typically a hydrophilic surface subjected to a prescribed hydrophilic treatment. Note that this specification defines "hydrophilia" as a state where the solid surface is in contact with the liquid and the gas and the contact angle being the angle defined by the liquid surface and the solid surface at the boundary line of contact of these three phases is below 90°.

As shown in FIG. 4, a surface of the support plate 474 on an opposite side of the elastic film 472 is fixed to the surface Q1 of the fixing plate 39. The support plate 474 is fixed to the surface Q1 by using an adhesive, for example. Thus, the opening 476 of the support plate 474 is blocked by the surface Q1 of the fixing plate 39. A space located inside the opening 476 of the support plate 474 and sandwiched between the elastic film 472 and the surface Q1 functions as a damper chamber for vibrating the elastic film 472.

As shown in FIG. 4, the fixing plate 39 includes a projection 391 that projects in the positive direction of the Z-axis on the periphery of the surface Q2. The projection 391 is a portion in the form of a rectangular frame located along an outer shape of the fixing plate 39. The projection 391 of the first embodiment is formed integrally with the fixing plate 39. Instead, the projection 391 formed separately from the fixing plate 39 may be fixed to the surface Q2 of the fixing plate 39. A surface in the positive direction of the Z-axis of the projection 391 is a water-repellent surface subjected to a prescribed water-repellent treatment. In this way, the ink is kept from sticking onto the surface of the projection 391.

As shown in FIGS. 3 and 4, the water-repellent film F is detachably provided to the surface Q2 of the fixing plate 39. A surface of the water-repellent film F being a surface in the positive direction of the Z-axis has water repellency. Meanwhile, a surface of the water-repellent film F in the negative direction of the Z-axis is provided with a not-illustrated pressure sensitive adhesive, for example. The water-repellent film F is fixed (attached) to the surface Q2 of the fixing plate 39 by using the pressure sensitive adhesive. Here, an adhesion strength between the water-repellent film F and the surface Q2 is improved when the surface Q2 is the hydrophilic surface subjected to the prescribed hydrophilic treatment. The water-repellent film F may be formed from a single thin-film member or formed by laminating two or more thin-film members.

Adhesive power of the pressure sensitive adhesive is such adhesive power that the water-repellent film F can be peeled off in the state where the water-repellent film F is attached to the surface Q2 of the fixing plate 39. To be more precise, the adhesive power of the pressure sensitive adhesive is set preferably in a range from 0.1 N/cm to 20 N/cm inclusive or more preferably in a range from 5.0 N/cm to 10 N/cm inclusive. The pressure sensitive adhesive preferably adopts any of acrylic-based, rubber-based, silicon-based, and urethane-based pressure sensitive adhesives.

Among the various materials mentioned above, the acrylic-based pressure sensitive adhesive is particularly preferred because its adhesive power has a certain range and this pressure sensitive adhesive is also excellent in its re-peeling property. Note that the re-peeling property is a property that allows easy peeling after once being attached without destroying the fixing plate 39 and leaving any pressure sensitive adhesive on the surface Q2. In other words, when the water-repellent film F is peeled off the surface Q2, the pressure sensitive adhesive is supposed to adhere to the water-repellent film F. When the cost is taken into account, it is desirable to use the rubber-based pressure sensitive adhesive. Meanwhile, when the peeling property is taken into account, it is desirable to use the urethane-based pressure sensitive adhesive.

As described above, in the first embodiment, the ejecting surface is formed from the nozzle forming surface 46S of the nozzle plate 46 and the surface of the water-repellent film F. As mentioned earlier, the wiping member 17 wipes the ejecting surface. In other words, the wiping member 17 comes into contact with the nozzle forming surface 46S and the surface of the water-repellent film F.

As shown in FIG. 2B, an inner peripheral surface of the projection 391 abuts on an outer peripheral surface of the water-repellent film F. Thus, the water-repellent film F is positioned at the inner peripheral surface. Accordingly, the water-repellent film F can be positioned (aligned) at high accuracy when providing the water-repellent film F on the surface Q2. In other words, this positioning avoids a situation where the nozzles N are blocked by the water-repellent film F due to the occurrence of an error in the location of the water-repellent film F, thereby improving the ease of attachment of the water-repellent film F. Meanwhile, as shown in FIG. 4, the surface of the projection 391 of the fixing plate 39 is located in the negative direction of the Z-axis relative to the surface of the water-repellent film F. This design suppresses peeling of a water-repellent film formed on the surface of the projection 391 at the time of wiping to wipe off the ink that adheres to the water-repellent film F provided on the surface Q2.

Here, the inner peripheral surface of the projection 391 does not always have to entirely abut on the outer peripheral surface of the water-repellent film F. At least part of the inner peripheral surface of the projection 391 may be configured to abut on the outer peripheral surface of the water-repellent film F as long as the water-repellent film F is positioned at the inner peripheral surface.

In general, an operation to wipe off the ink adhering to the ejecting surface of the head by the wiping member such as the wiper, an operation to forcibly discharge the ink from each nozzle by reducing the pressure in the space inside the cap in the state where the ejecting surface is sealed with the cap, or the like is executed as a maintenance operation for the liquid ejecting head. When the maintenance operation is executed, the water-repellent film formed on the ejecting surface subjected to the water-repellent treatment is prone to wear and get peeled off by repeating the operation to wipe the ejecting surface by the wiping member and the operation to press the ejecting surface against the tip end of the cap, whereby the water repellency of the ejecting surface may not be ensured as a consequence.

On the other hand, the liquid ejecting head 26 is detachably provided to the surface Q2 located in the positive direction of the Z-axis relative to the nozzle forming surface 46S provided with the openings of the nozzles N in such a way as to expose the nozzle forming surface 46S in the positive direction of the Z-axis as described above. According to this configuration, the surface Q2 provided with the water-repellent film F is located in the Z direction relative to the nozzle forming surface 46S. Thus, the nozzle forming surface 46S is less likely to be pressed by the wiping member 17 excessively at the time of wiping to wipe off the ink adhering to the water-repellent film provided to the surface Q2. As a consequence, the wear of the nozzle forming surface 46S attributed to the wiping is suppressed and the water repellency of the nozzle forming surface 46S is thus ensured. Moreover, since the water-repellent film F is detachably provided to the surface Q2, the water repellency of the surface Q2 is also ensured by replacing the water-repellent film F with a new film even if the water-repellent film F wears out in the course of the wiping. Particularly, in the first embodiment, the distance D1 between the nozzle forming surface 46S and the surface Q2 in the positive direction of the Z-axis is larger than the thickness of the water-repellent film F. Accordingly, the nozzle forming surface 46S is located at a position in the negative direction of the Z-axis. Thus, the nozzle forming surface 46S is even less likely to be pressed by the wiping member 17 at the time of wiping to wipe off the ink adhering to the water-repellent film F provided to the surface Q2. As a consequence, the nozzle forming surface 46S is effectively kept from wearing attributed to the wiping.

As shown in FIG. 2B, the water-repellent film F of the first embodiment includes a first film member F1 and a second film member F2. Dashed lines in FIG. 2B represent the first film member F1 and the second film member F2. The first film member F1 and the second film member F2 are film members that are formed separately from each other. The first film member F1 corresponds to the liquid ejecting unit 32-1 while the second film member F2 corresponds to the liquid ejecting unit 32-2. As shown in FIG. 2B, the first film member F1 includes an opening Fh-1 that exposes the first nozzle forming surface 46-1S of the nozzle plate 46-1 in the positive direction of the Z-axis, and the second film member F2 includes an opening Fh-2 that exposes the second nozzle forming surface 46-2S of the nozzle plate 46-2 in the positive direction of the Z-axis. In the following description, each of the opening Fh-1 and the opening Fh-2 will be simply referred to as the "opening Fh" when the distinction is not necessary. The opening Fh has such a shape that corresponds to the opening 392 of the fixing plate 39. Specifically, an inner peripheral edge of the opening Fh overlaps an inner peripheral edge of the opening 392 in view of the direction of the Z-axis.

The first nozzle forming surface 46-1S of the liquid ejecting unit 32-1 is exposed to the inside of the opening Fh-1 of the first film member F1 while the second nozzle forming surface 46-2S of the liquid ejecting unit 32-2 is exposed to the inside of the opening Fh-2 of the second film member F2. In other words, as shown in FIG. 2B, the first film member F1 is provided to the surface Q2-1 that surrounds the first nozzle forming surface 46-1S about the Z-axis in view of the negative direction of the Z-axis. Likewise, the second film member F2 is provided to the surface Q2-2 that surrounds the second nozzle forming surface 46-2S about the Z-axis in view of the negative direction of the Z-axis. In the meantime, an outer shape of the surface Q2 substantially coincides with an outer shape of the water-repellent film F in view of the opposite direction to the ejecting direction. To be more precise, an outer shape of the surface Q2-1 substantially coincides with an outer shape of the first film member F1 and an outer shape of the surface Q2-2 substantially coincides with an outer shape of the second film member F2 in view of the opposite direction to the ejecting direction.

As described above, the surface Q2-1 and the surface Q2-2 are the surfaces that are provided side by side along the X-axis and are continuous with each other. Meanwhile, the water-repellent film F is configured to substantially eliminate a gap between the first film member F1 and the second film member F2. Moreover, in this embodiment, the cap 18 is provided corresponding to the liquid ejecting head 26 and configured to seal the first nozzles N1 and the second nozzles N2 at the same time. In other words, the tip end of the cap 18 abuts on the abutting surface T, which is provided across the surface of the first film member F1 and the surface of the second film member F2, in such a way as to surround the opening Fh-1 and the opening Fh-2 in view of the direction of the X-axis. A chain line in FIG. 2B represents the abutting surface T. In this way, a sealing performance between the cap 18 and the surface Q2 is improved when the tip end of the cap 18 is brought into contact with the abutting surface T being part of the surface of the water-repellent film F to seal the nozzles N1 and N2 and the sealed nozzles N1 and N2 are cleaned in the maintenance operation for the liquid ejecting head 26. Here, the aforementioned concept of "substantial elimination of a gap" means that the first film member F1 and the second film member F2 are at least partially in contact with each other, for example. Furthermore, since the tip end of the cap 18 abuts on the abutting surface T being part of the surface of the water-repellent film F, abutting surface T is prone to deterioration of water repellency. However, since the abutting surface T is provided on the surface of the replaceable water-repellent film F, the deterioration of water repellency of the ejecting surface of the liquid ejecting head 26 can be suppressed by replacing the water-repellent film F.

Note that the first film member F1 and the second film member F2 may be arranged with a gap in between when the caps 18 are provided corresponding to the opening Fh-1 and the opening Fh-2, respectively. As long as the first film member F1 is fixed to the surface Q2-1 in such a way as to surround the opening Fh-1 in view of the direction of the Z-axis, for example, this configuration can also improve the sealing performance between the first film member F1 and the cap 18 by causing the tip end of the cap 18 to abut on the surface of the first film member F1. The same applies to the second film member F2. The aforementioned operation to improve the sealing performance is remarkable particularly when the gap is provided between the first film member F1 and the second film member F2 as a consequence of forming the abutting surface across both the surface of the water-repellent film F and the surface Q2 which have different heights from each other, for instance.

The first film member F1 corresponds to the first nozzles N1 formed in the liquid ejecting unit 32-1. The second film member F2 corresponds to the second nozzles N2 formed in the liquid ejecting unit 32-2. Specifically, the first ink ejected from the liquid ejecting unit 32-1 is likely to adhere to the first film member F1 and the second ink ejected from the liquid ejecting unit 32-2 is likely to adhere to the second film member F2. As mentioned above, the Mohs hardness of the pigment particles contained in the first ink is higher than the Mohs hardness of the pigment particles contained in the second ink. Accordingly, the surface of the first film member F1 is more likely to deteriorate due to the contact with the pigment particles as compared to the second film member F2. In other words, the degree of deterioration of the first film member F1 is different from that of the second film member F2. Since the water-repellent film F is formed from the first film member F1 and the second film member F2 in the first embodiment, only the film member that deteriorates more out of the first film member F1 and the second film member F2 can be replaced selectively. Thus, it is possible to ensure the water repellency of the surface Q2 at lower cost than the case of replacing the entire water-repellent film F.

The thickness of the water-repellent film F is smaller than the distance D1 between the surface Q2 of the fixing plate 39 and the nozzle forming surface 46S of the nozzle plate 46. To be more precise, the thickness of the water-repellent film F is preferably in a range from 30 μm to 50 μm inclusive. However, this thickness may be around 3 μm instead. The material of the water-repellent film F is not limited as long as the film has water repellency against the inks. For example, the water-repellent film F is a film formed by conducting the prescribed water-repellent treatment on a superficial layer of a thin film made of a polymeric resin material such as polyethylene terephthalate and polypropylene.

Meanwhile, the wiping operation on the ejecting surface is performed in this embodiment while moving the liquid ejecting head 26 relative to the wiping member 17 in the positive direction of the X-axis as shown in FIG. 2B. Specifically, the wiping member 17 wipes the ejecting surface while moving relative to the ejecting surface of the liquid ejecting head 26 in the negative direction of the X-axis. In other words, the wiping member 17 wipes the ejecting surface along the direction from the second nozzle forming surface 46-2S to the first nozzle forming surface 46-1S. In this case, when the film member corresponding to the nozzles N which eject the ink that is more likely to deteriorate the water-repellent film F is wiped after wiping the film member corresponding to the nozzles N which eject the ink that is less likely to deteriorate the water-repellent film F, the wiping member 17 is kept from wiping the film member corresponding to the nozzles N which eject the ink that is less likely to deteriorate the water-repellent film F while retaining the liquid that is more likely to deteriorate the water-repellent film F. Accordingly, it is possible to delay the progress of deterioration of the film member corresponding to the nozzles N which eject the ink that is less likely to deteriorate the water-repellent film F.

B: SECOND EMBODIMENT

A description will be given of a second embodiment of the present disclosure. Note that the elements in the following examples having similar functions to those of the first embodiment will be denoted by the reference numerals used in the description of the first embodiment and detailed explanations thereof will be omitted as appropriate.

Figure 5:
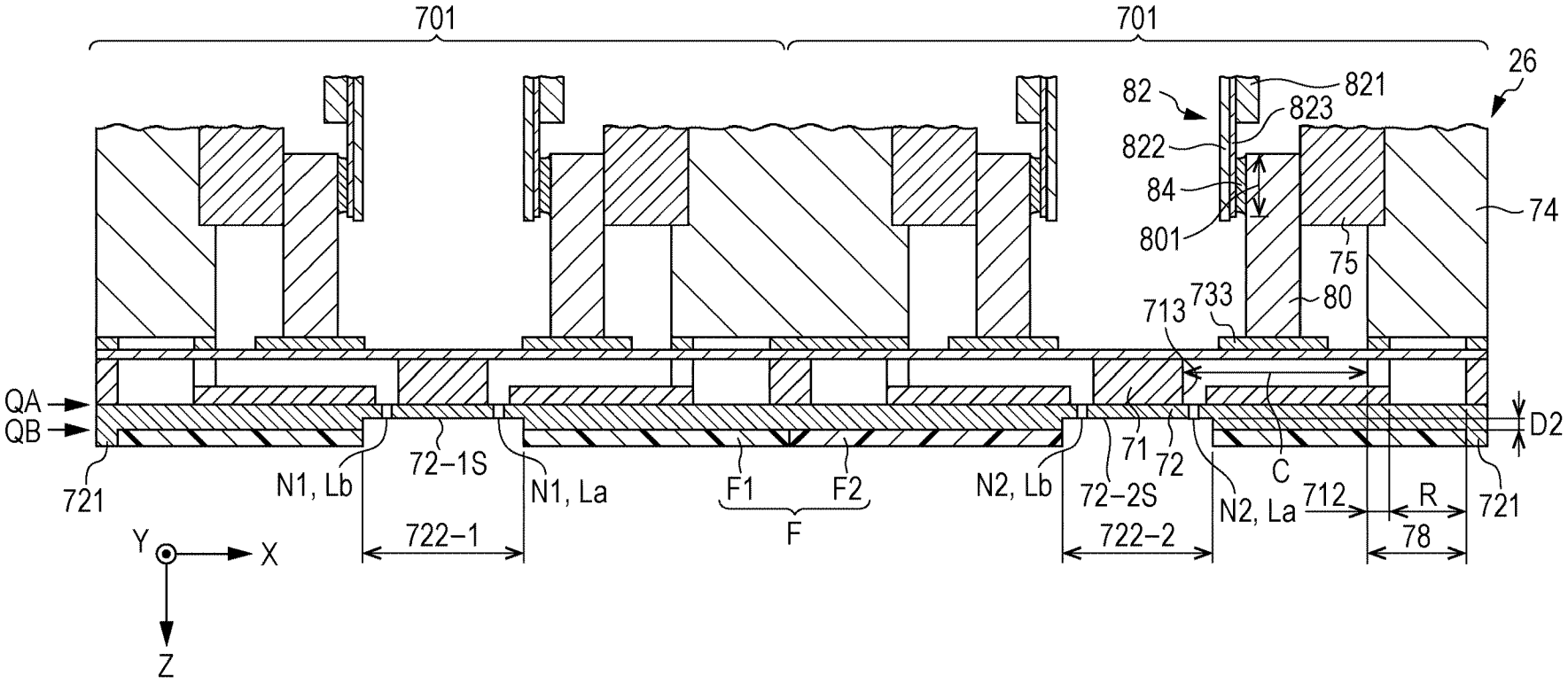
FIG. 5 is a cross-sectional view showing a configuration example of a liquid ejecting head according to a second embodiment of the present disclosure.
Figure 6:
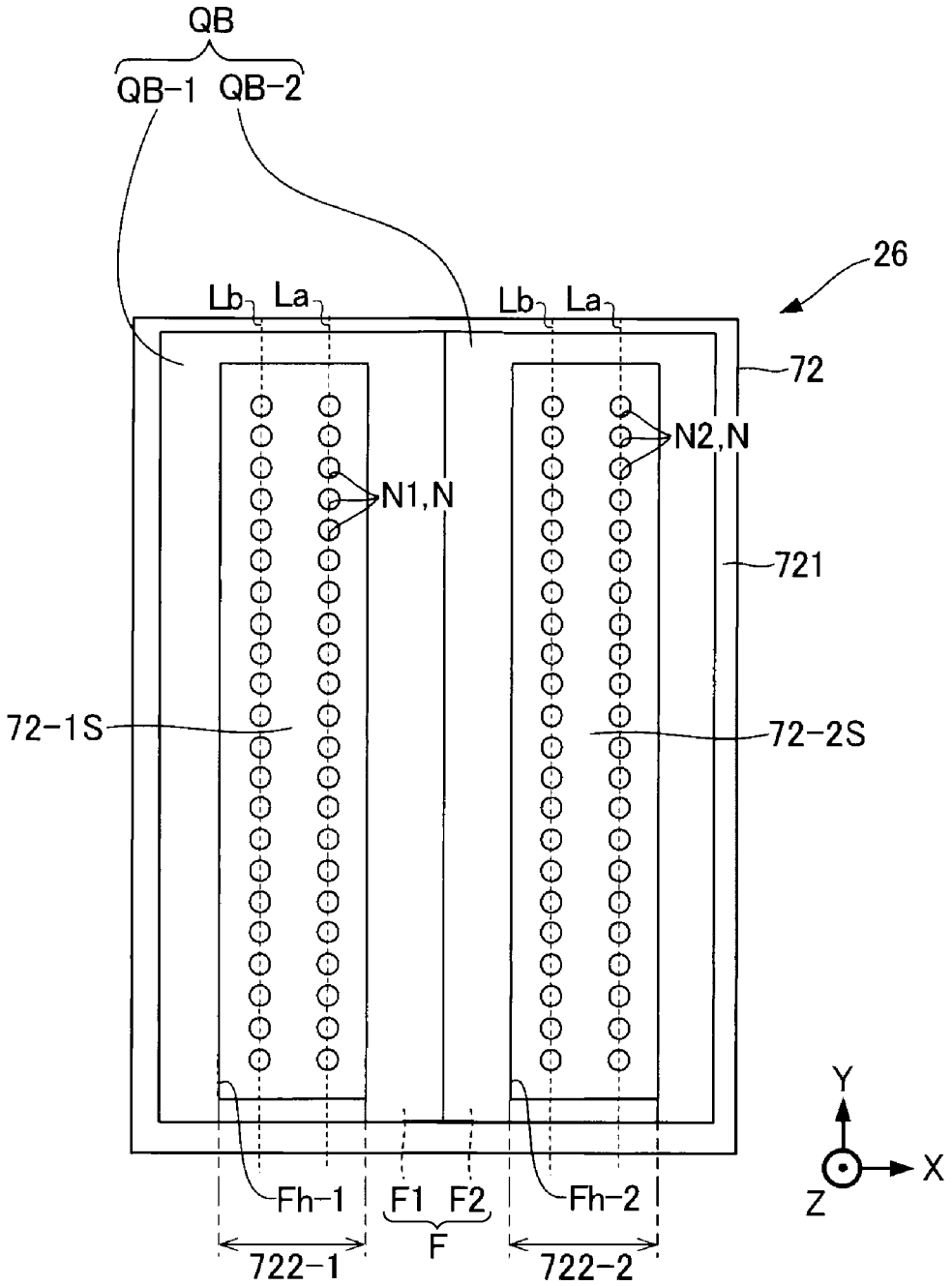
FIG. 6 is a schematic diagram of the liquid ejecting head of the second embodiment viewed from the opposite direction to the ejecting direction.

FIG. 5 is a cross-sectional view of the liquid ejecting head 26 of the second embodiment and FIG. 6 is a schematic diagram of the liquid ejecting head 26 in view of the negative direction of the Z-axis. As shown in FIG. 5, the liquid ejecting head 26 of the second embodiment includes liquid ejecting units 701, piezoelectric elements 80, and wiring substrates 82.

The liquid ejecting units 701 are head chips that eject the liquids from the nozzles N. Each liquid ejecting unit 701 is a structure in which the elements related to the first row La and the elements related to the second row Lb are plane-symmetrically formed with respect to a symmetrical plane that is parallel to the Y-Z plane.

The liquid ejecting units 701 include a shared flow channel substrate 71, a shared nozzle plate 72, a shared vibrating plate 73, a shared housing unit 74, and fixing members 75. The nozzle plate 72 is joined to a surface of the flow channel substrate 71 directed to the positive direction of the Z-axis, while the vibrating plate 73 is joined to a surface of the flow channel substrate 71 directed to the negative direction of the Z-axis. The nozzle plate 72 is provided with the nozzles N.

As shown in FIG. 5, the nozzle plate 72 is a plate member having a surface QA and a surface QB. The surface QA is a surface on the opposite side of the surface QB. The surface of the flow channel substrate 71 directed to the positive direction of the Z-axis is fixed to the surface QA with an adhesive, for example. Thus, the nozzle plate 72 is shared by the liquid ejecting units 701.

As shown in FIG. 5, the nozzle plate 72 is provided with an opening 722-1 and an opening 722-2 opened to the positive direction of the Z-axis. The opening 722-1 and the opening 722-2 are recesses arranged in the direction of the X-axis at a given interval in between. In the following description, each of the opening 722-1 and the opening 722-2 will be simply referred to as the "opening 722" when the distinction is not necessary. Each opening 722 is a rectangular recess which is elongate in the direction of the Y-axis. Each nozzle N of the second embodiment is a through hole that establishes communication between a space defined by the opening 722 and the pressure chamber C. Specifically, a bottom surface of the opening 722 directed to the positive direction of the Z-axis is the nozzle forming surface 72S in which openings of the nozzles N are formed. To be more precise, a bottom surface of the opening 722-1 directed to the positive direction of the Z-axis is a first nozzle forming surface 72-1S in which openings of the first nozzles N1 are formed, while a bottom surface of the opening 722-2 directed to the positive direction of the Z-axis is a second nozzle forming surface 72-2S in which openings of the second nozzles N2 are formed. In the following description, each of the first nozzle forming surface 72-1S and the second nozzle forming surface 72-2S will be simply referred to as the "nozzle forming surface 72S" when the distinction is not necessary.

Each nozzle forming surface 72S is subjected to a prescribed water-repellent treatment in light of favorably forming a meniscus of the ink ejected from each nozzle N. A distance D2 between the nozzle forming surface 72S and the surface QB shown in FIG. 5 is equal to 0.004 mm, for example. A dimension of the opening 722 in the direction of the X-axis is equal to 0.221 mm, for example.

As shown in FIG. 5, the surface QB is located in the positive direction of the Z-axis relative to the nozzle forming surface 72S. As shown in FIGS. 5 and 6, the surface QB includes a surface QB-1 which is located adjacent to the first nozzle forming surface 72-1S in view of the direction of the Z-axis and surrounds the first nozzle forming surface 72-1S about the Z-axis, and a surface QB-2 which is located adjacent to the second nozzle forming surface 72-2S in view of the direction of the Z-axis and surrounds the second nozzle forming surface 72-2S about the Z-axis. The surface QB is typically a hydrophilic surface subjected to a prescribed hydrophilic treatment. However, the surface QB may be a water-repellent surface instead.

As shown in FIG. 5, the nozzle plate 72 includes a projection 721 that projects in the positive direction of the Z-axis on the periphery of the surface QB. The projection 721 is a portion in the form of a rectangular frame located along an outer shape of the nozzle plate 72. The projection 721 of the second embodiment is formed integrally with the nozzle plate 72. Instead, the projection 721 formed separately from the nozzle plate 72 may be fixed to the surface QB of the nozzle plate 72. In this case, the projection 721 may be a frame body such as a cover provided on the periphery of the surface QB, for instance. A surface in the positive direction of the Z-axis of the projection 721 is a water-repellent surface subjected to the prescribed water-repellent treatment. In this way, the ink is kept from sticking onto the surface of the projection 721.

For example, the nozzle plate 46 is manufactured by processing the silicon (Si) single crystal substrate by means of photolithography, etching, and the like. When the nozzle plate 72 is manufactured by etching, the second embodiment may adopt a two-stage etching method designed to form the projection 721 by etching the silicon (Si) single crystal substrate and then forming the opening 722 by further etching the substrate. Nevertheless, other publicly known materials and manufacturing methods may be adopted to manufacture the nozzle plate 46 as appropriate.

As shown in FIG. 5, the water-repellent film F is detachably provided to the surface QB of the nozzle plate 72. The surface of the water-repellent film F being the surface in the positive direction of the Z-axis has water repellency. Meanwhile, the surface of the water-repellent film F in the negative direction of the Z-axis is provided with a not-illustrated pressure sensitive adhesive, for example. The water-repellent film F is fixed to the surface QB of the nozzle plate 72 by using the not-illustrated pressure sensitive adhesive, for example. Here, an adhesion strength between the water-repellent film F and the surface QB is improved when the surface QB is the hydrophilic surface subjected to the prescribed hydrophilic treatment. In the second embodiment, the ejecting surface is formed from the nozzle forming surface 72S of the nozzle plate 72 and the surface of the water-repellent film F. The wiping member 17 wipes the ejecting surface. In other words, the wiping member 17 comes into contact with the nozzle forming surface 72S and the surface of the water-repellent film F.

As shown in FIG. 6, an inner peripheral surface of the projection 721 abuts on the outer peripheral surface of the water-repellent film F. Thus, the water-repellent film F is positioned at the inner peripheral surface. As shown in FIG. 5, the water-repellent film F of the second embodiment includes the first film member F1 and the second film member F2.

The first film member F1 and the second film member F2 are the film members that are formed separately from each other. The first film member F1 corresponds to the first nozzles N1 while the second film member F2 corresponds to the second nozzles N2. As shown in FIG. 6, the first film member F1 and the second film member F2 include the opening Fh-1 that exposes the first nozzle forming surface 72-1S of the nozzle plate 72 in the positive direction of the Z-axis and the opening Fh-2 that exposes the second nozzle forming surface 72-2S of the nozzle plate 72 in the positive direction of the Z-axis, respectively. In the following description, each of the opening Fh-1 and the opening Fh-2 will be simply referred to as the "opening Fh" when the distinction is not necessary. The opening Fh has a shape that corresponds to the opening 722 of the nozzle plate 72. Specifically, an inner peripheral edge of the opening Fh overlaps an inner peripheral edge of the opening 722 in view of the direction of the Z-axis.

The nozzle forming surface 72S provided with the openings of the first nozzles N1 is exposed to the inside of the opening Fh of the first film member F1 while the nozzle forming surface 72S provided with the openings of the second nozzles N2 is exposed to the inside of the opening Fh of the second film member F2. In other words, as shown in FIG. 6, the water-repellent film F is provided to the surface QB that surrounds the nozzle forming surface 72S about the Z-axis in view of the negative direction of the Z-axis.

The first film member F1 corresponds to the openings of the first nozzles N1 while the second film member F2 corresponds to the openings of the second nozzles N2. Specifically, the first ink ejected from the first nozzles N1 is likely to adhere to the first film member F1 and the second ink ejected from the second nozzles N2 is likely to adhere to the second film member F2. As discussed in the first embodiment, the Mohs hardness of the pigment particles contained in the first ink is higher than the Mohs hardness of the pigment particles contained in the second ink. Accordingly, the surface of the first film member F1 is more likely to deteriorate due to the contact with the pigment particles as compared to the second film member F2. In other words, the degree of deterioration of the first film member F1 is different from that of the second film member F2. In the second embodiment, the water-repellent film F is formed from the first film member F1 and the second film member F2 as with the first embodiment. Accordingly, the same operation and effect as those of the first embodiment are obtained.

As described above, in the liquid ejecting head 26 of the second embodiment, the water-repellent film is detachably provided to the surface QB which is located adjacent to the nozzle forming surface 72S in view of the negative direction of the Z-axis and is located in the positive direction of the Z-axis relative to the nozzle forming surface 72S. Accordingly, the same operation and effect as those of the first embodiment are obtained. Moreover, it is possible to form a step between the nozzle forming surface 72S and the surface QB without providing the fixing plate 39 as compared to the first embodiment, thereby reducing the cost.

The flow channel substrate 71 is provided with a liquid storage chamber R, first flow channels 712, pressure chambers C, and second flow channels 713. The liquid storage chamber R is a shared liquid chamber that extends across the nozzles N. The first flow channels 712, the second flow channels 713, and the pressure chambers C are formed to correspond to the respective nozzles N. Each first flow channel 712 is a restrictive flow channel that establish communication between the corresponding pressure chamber C and the liquid storage chamber R. The liquid storage chamber R and the first flow channels 712 collectively function as supply flow channels 78 that supply the ink to the pressure chambers C. The second flow channels 713 establish communication between the pressure chambers C and the nozzles N.

The vibrating plate 73 is formed from an elastic film 731 and a support plate 732. The elastic film 731 is joined to a surface of the flow channel substrate 71 and the support plate 732 is stacked on the elastic film 731. The elastic film 731 is made of a para-aramid resin, for example, while the support plate 732 is made of stainless steel, for example. Island-shaped portions 733 that overlap the pressure chambers C are formed by partially removing the support plate 732.

The housing unit 74 is joined to the surface of the vibrating plate 73 directed to the negative direction of the Z-axis while the fixing member 75 is fixed to the housing unit 74. Each piezoelectric element 80 is a vertically vibrating driving element formed by alternately laminating piezoelectric layers and electrode layers, and its tip end portion abuts on the corresponding island-shaped portion 733. When the island-shaped portion 733 vibrates together with the elastic film 731 along with deformation of the piezoelectric element 80, the ink filling the pressure chamber C is ejected through the second flow channel 713 and the nozzle N. Connection terminals 801 are formed on a side surface of each piezoelectric element 80.

Each wiring substrate 82 includes a base material 822 that mounts a driving circuit 821, and signal lines 823. The respective signal lines 823 on the wiring substrate 82 are electrically coupled to the connection terminals 801 of each piezoelectric element 80 by using solder 84.

C: MODIFIED EXAMPLES

While the embodiments of the present disclosure have been described above, this disclosure is not limited only to the above-described embodiments but various changes can be applied thereto. Specific aspects of modifications that can be applied to the above-described embodiments are disclosed below as examples. Here, two or more aspects may be selected arbitrarily from the following exemplary aspects and combined as appropriate to the extent compatible with each other.

Figure 7:
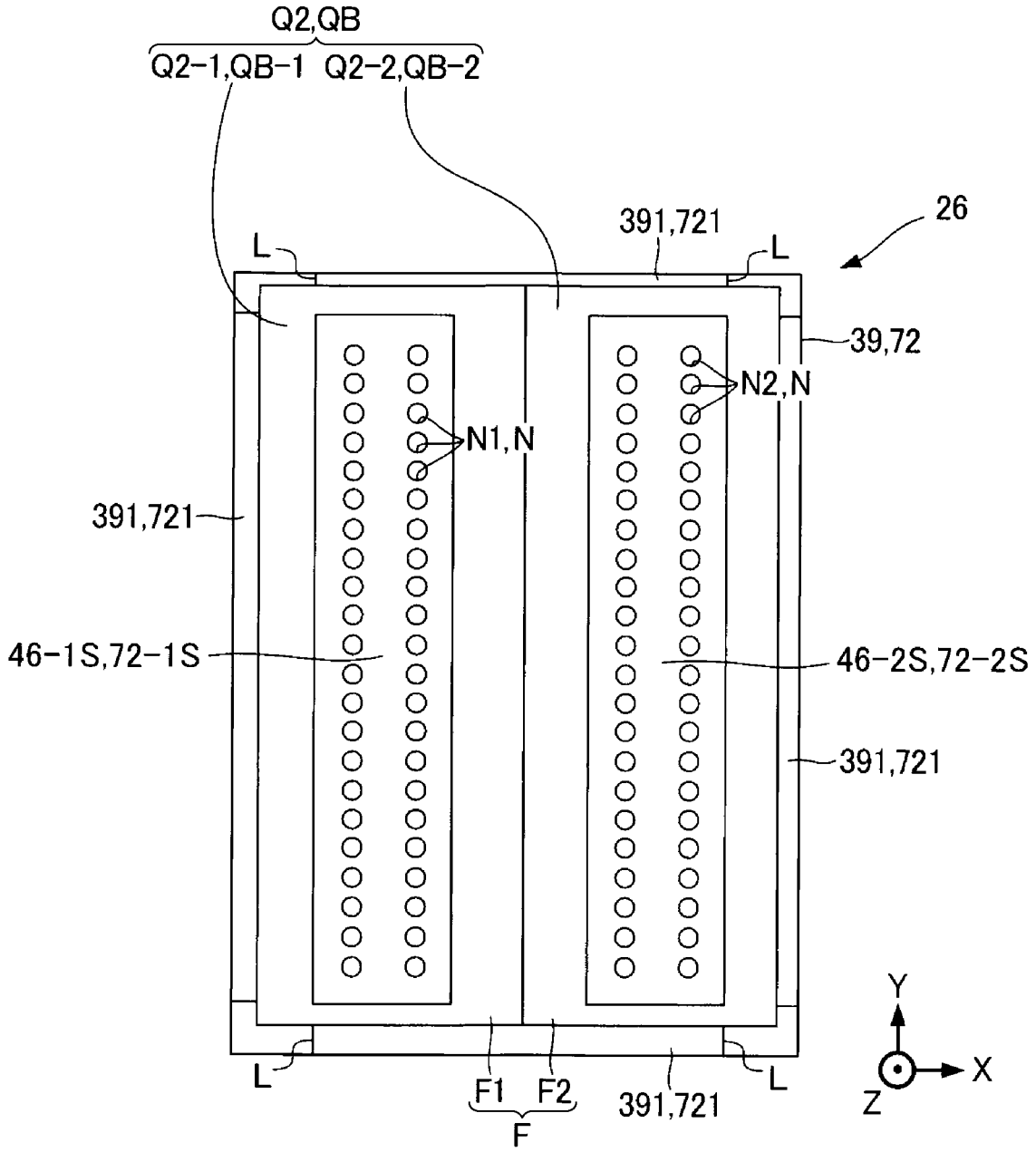
FIG. 7 is a schematic diagram of a liquid ejecting head according to a modified example viewed from the opposite direction to the ejecting direction.
Figure 8:
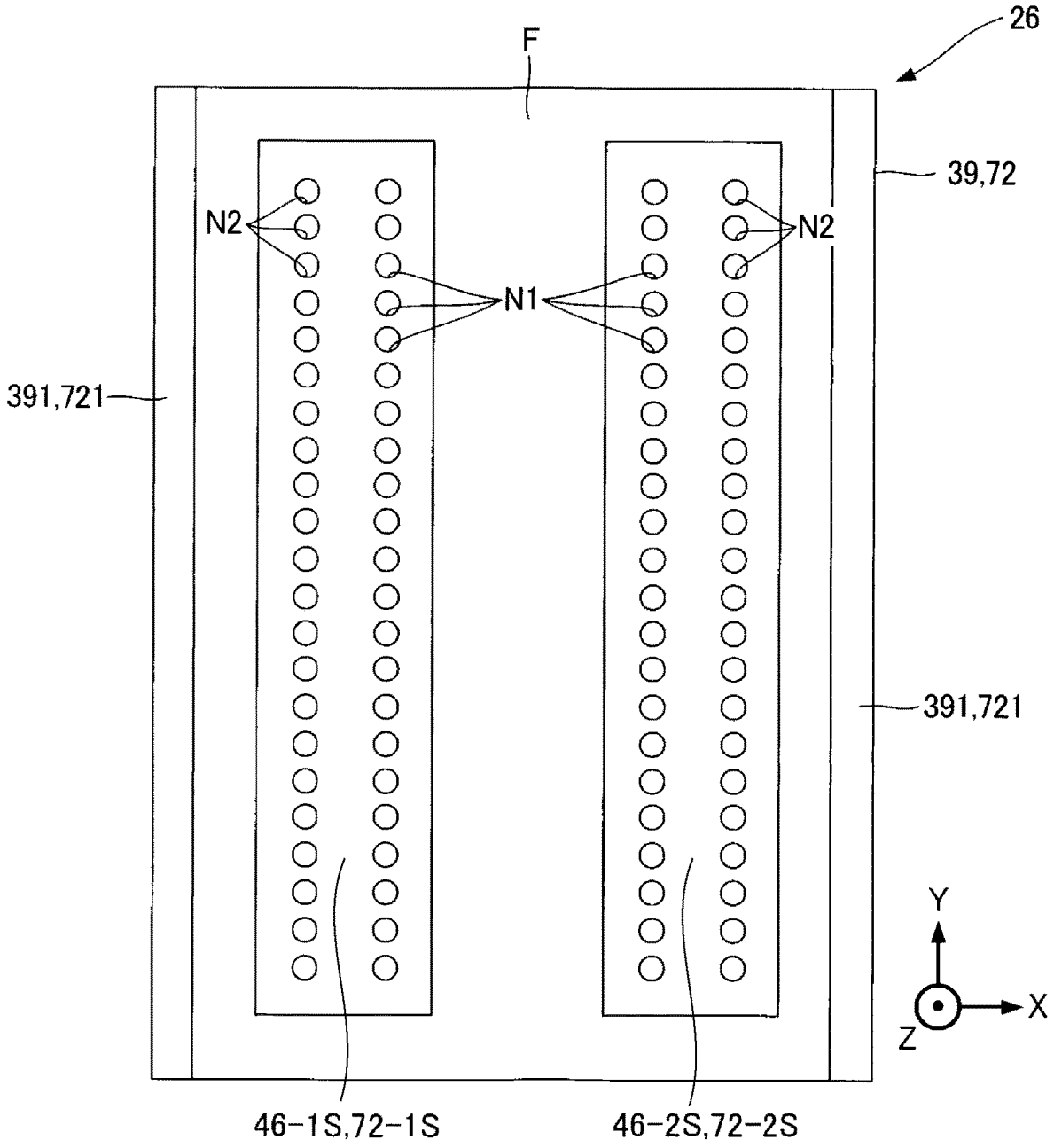
FIG. 8 is a schematic diagram of a liquid ejecting head according to another modified example viewed from the opposite direction to the ejecting direction.

(1) FIGS. 7 and 8 are schematic diagrams of the liquid ejecting head 26 in a modified example viewed in the direction of the Z-axis. The projections 391 and 721 are not limited only to the configurations in the rectangular frame shapes as shown in FIGS. 2A, 2B, and 6, but may be configured such that at least part of any of the projections abuts on the outer peripheral surface of the water-repellent film F. To be more precise, the projections 391 and 721 may be provided intermittently around the Z-axis on the periphery of the surface Q2 as shown in FIG. 7, for example. This configuration makes it possible to detach the water-repellent film F by using a cutout L between one projection and another projection, and thus to improve the ease of replacing the deteriorated water-repellent film F. Alternatively, the projections 391 and 721 may be configured to abut only on side surfaces in a longitudinal direction of the water-repellent film F as shown in FIG. 8. In the meantime, as show in FIG. 8, the water-repellent film F may be a single film member provided with the two openings Fh-1 and Fh-2 that correspond to the first nozzle forming surface 46-1S and the second nozzle forming surface 46-2S, respectively. Since there is just one film member, this configuration facilitates replacement of the water-repellent film F.

Figure 9:
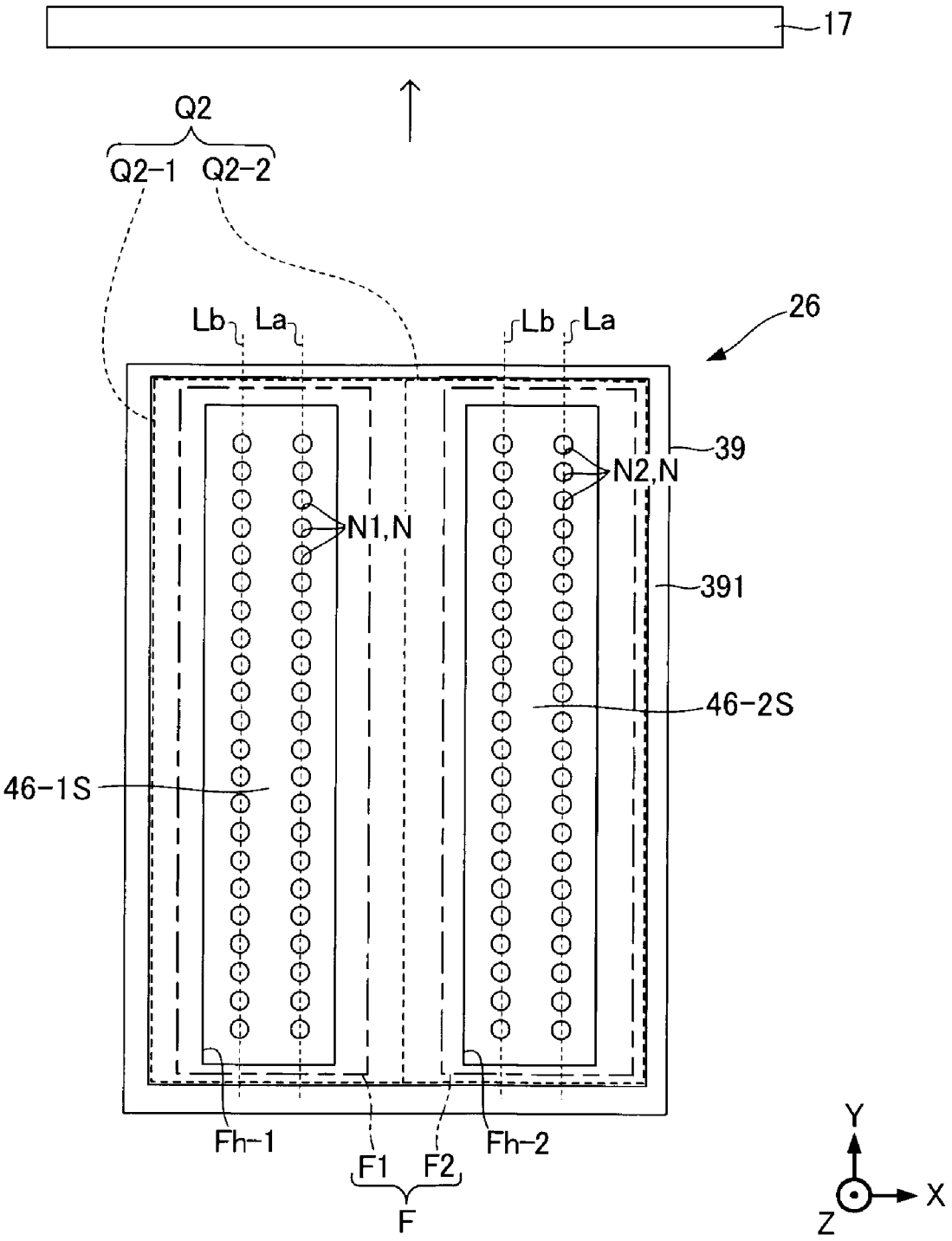
FIG. 9 is a diagram for explaining a direction of wiping an ejecting surface of the liquid ejecting head by a wiping member according to another modified example.

(2) FIG. 9 is a diagram for explaining a direction of wiping the ejecting surface by the wiping member 17 according to another modified example. In the above-described embodiments, the wiping member 17 wipes the surface of the first film member F1 and the surface of the second film member F2 in the direction from the second nozzle forming surface 46-2S to the first nozzle forming surface 46-1S. Instead, the wiping member 17 may wipe the surface of the first film member F1 and the surface of the second film member F2 in a direction orthogonal to the direction of arrangement of the first nozzle forming surface 46-1S and the second nozzle forming surface 46-2S. In this way, the wiping member 17 is kept from wiping the film member corresponding to the nozzles N which eject the ink that is less likely to deteriorate the water-repellent film F while retaining the ink that is more likely to deteriorate the water-repellent film F. Accordingly, it is possible to delay the progress of deterioration of the film member corresponding to the nozzles N which eject the ink that is less likely to deteriorate the water-repellent film F. Note that the surface of the first film member F1 and the surface of the second film member F2 may be wiped at the same time or wiped at different timings by the wiping member 17 in this modified example.

(3) Although the outer shape of the surface Q2 substantially coincides with the outer shape of the water-repellent film F in view of the opposite direction to the ejecting direction in the first embodiment, the outer shape of the water-repellent film F does not always have to coincide with the outer shape of the surface Q2 in view of the opposite direction to the ejecting direction. For example, as shown in FIG. 9, the outer shape of the first film member F1 indicated with a chain line may be slightly smaller than the outer shape of the surface Q2-1 indicated with a dashed line, and the outer shape of the second film member F2 indicated with a chain line may be slightly smaller than the outer shape of the surface Q2-2 indicated with a dashed line. This configuration can also suppress deterioration of water repellency around the nozzle forming surface 46S. Here, a portion of the surface Q2 to which the water-repellent film F is not attached may be subjected to the water-repellent treatment while a portion thereof to which the water-repellent film F is attached may be withheld from the water-repellent treatment and be thus rendered hydrophilic.

(4) Each of the first ink and the second ink may be a pigment ink that contains an inorganic pigment as its coloring material, for example. The first ink is a white ink that contains a white pigment made of titanium oxide, for example. The second ink is a pigment ink other than the white ink. The second ink contains an inorganic pigment such as carbon black. The white ink that contains titanium oxide is more likely to deteriorate the water-repellent film F as compared to the second ink that contains carbon black. Accordingly, as with the first embodiment, it is desirable to adopt the configuration in which the water-repellent film F is formed from the first film member F1 and the second film member F2 so that one of the film members can be selectively replaced. In this modified example, each of the first ink and the second ink is assumed to be the pigment ink that contains the inorganic pigment as the coloring material, for example. Instead, the first ink may be the ink that contains the inorganic pigment while the second ink may be an ink that does not contain any inorganic pigment. The first ink that contains the inorganic pigment is prone to deteriorate the water-repellent film F as compared to the second ink that does not contain the inorganic pigment. Accordingly, as with the aforementioned aspect, it is desirable to adopt the configuration in which the water-repellent film F is formed from the first film member F1 and the second film member F2 so that one of the film members can be selectively replaced. Alternatively, the first ink may be the pigment ink while the second ink may be a dye ink. The pigment ink is prone to deteriorate the water-repellent film F with the pigment particles as compared to the dye ink. Accordingly, when the first ink is the pigment ink and the second ink is the dye ink, it is desirable to adopt the configuration in which the water-repellent film F is divided into the first film member F1 and the second film member F2. Although the description has been given above of the advantage of the configuration to divide the water-repellent film F into the first film member F1 and the second film member F2 when any of the first ink and the second ink is the pigment ink, both of the first ink and the second ink may be or may not be the pigment inks according to the technique of the present disclosure. In such a case, the first ink and the second ink may be the inks of the same type. For instance, both of the first ink and the second ink may be dye inks. In the meantime, an average grain size of the pigment particles contained in the first ink may be larger than an average grain size of the pigment particles contained in the second ink. The aforementioned average grain size means a grain size at an integrated value of 50% in grain size distribution obtained by the laser diffraction scattering method, for example. The first ink that has the larger average grain size of the pigment particles is more likely to deteriorate the water-repellent film F as compared to the second ink that has the small average grain size of the pigment particles. Accordingly, as with the aforementioned aspect, it is desirable to adopt the configuration in which the water-repellent film F is formed from the first film member F1 and the second film member F2 so that one of the film members can be selectively replaced.

(5) In the embodiments and the modified examples described above, the water-repellent film F is formed either from the two film members of the first film member F1 and the second film member F2 or from the single film member. Instead, the water-repellent film F may be formed from three or more film members.

(6) In the above-described embodiments, the first nozzles N1 are formed in the first nozzle forming surfaces 46-1S and 72-1S while the second nozzles N2 are formed in the second nozzle forming surfaces 46-2S and 72-2S. However, the configurations of the nozzles are not limited to the foregoing. For example, as shown in FIG. 8, some of the first nozzles N1 and some of the second nozzles N2 may be formed in the first nozzle forming surfaces 46-1S and 72-1S while the rest of the first nozzles N1 and the rest of the second nozzles N2 may be formed in the second nozzle forming surfaces 46-2S and 72-2S. In this case, some of the first nozzles N1 and some of the second nozzles N2 formed in the first nozzle forming surfaces 46-1S and 72-1S represent an example of the "first nozzles" while the rest of the first nozzles N1 and the rest of the second nozzles N2 formed in the second nozzle forming surfaces 46-2S and 72-2S represent an example of the "second nozzles". Meanwhile, the water-repellent film F formed from the single film member corresponds to the first nozzles N1 and the second nozzles N2 formed in the two nozzle forming surfaces 46S and 72S, respectively. Here, when the water-repellent film F in FIG. 8 is formed from the two film members of the first film member F1 and the second film member F2 as in the case of the above-described embodiments, the first film member F1 corresponds to the first nozzles N1 and the second nozzles N2 formed in the in the first nozzle forming surfaces 46-1S and 72-1S while the second film member F2 corresponds to the first nozzles N1 and the second nozzles N2 formed in the second nozzle forming surfaces 46-2S and 72-2S.

(7) In the above-described embodiments, the rows of the nozzles are formed by arranging the nozzles N along the Y-axis. Instead, the rows of the nozzles may be formed by arranging the nozzles N in the direction crossing both the Y-axis and the X-axis in view of the direction of the Z-axis. In other words, the rows of the nozzles may be inclined relative to the Y-axis. In the meantime, the respective shapes of the nozzle plates 46 and 72, the water-repellent film F, the openings Fh in the water-repellent film F, the surface Q2 of the fixing plate 39, the nozzle forming surface 72S, and the ejecting surface are rectangles that are elongate in the Y-axis. However, the shapes are not limited to the rectangles and may be parallelograms or trapezoids, for instance.

D: SUPPLEMENTS

Besides the apparatus dedicated to printing, the liquid ejecting apparatuses shown as the examples in the above-described aspects may also be adopted to various apparatuses including a facsimile apparatus, a copier, and the like and applications of the present disclosure are not limited to particular apparatuses. As a matter of fact, the usage of the liquid ejecting apparatus is not limited only to printing. For example, a liquid ejecting apparatus that ejects a solution of a coloring material is used as a manufacturing apparatus for forming a color filter of a display device such as a liquid crystal display panel. Meanwhile, a liquid ejecting apparatus that ejects a solution of a conductive material is used as a manufacturing apparatus for forming wiring and electrodes on a wiring board. In the meantime, a liquid ejecting apparatus that ejects a solution of an organic substance related to a biological object is used as a manufacturing apparatus for manufacturing a biochip, for instance.

Meanwhile, the liquid ejecting apparatus shown as the example in each of the above-described embodiments is a so-called serial printer that performs printing by causing the liquid ejecting head 26 to eject the liquids onto a medium while causing the transport body 242 serving as the carriage to reciprocate along the X-axis being a main scanning direction. However, the present disclosure may also be applied to a so-called elongate line head and to a line printer provided with the line head, in which the liquid ejecting head does not perform scanning in the main scanning direction.

Moreover, the effects disclosed in this specification are merely explanatory or exemplary, and are not restrictive. That is to say, in addition to or in place of the above-described effects, the present disclosure can also bring about other effects that are obvious to the person skilled in the art from the description of this specification.

Although the preferred embodiments of the present disclosure have been described above in detail with reference to the accompanying drawings, the present disclosure is not limited only to these examples. It is obvious that a person with the ordinary skill in the art can easily arrive at various other modified examples or improved examples within the scope of the technical ideas as defined in the appended claims. It is to be understood that those modified examples and improved examples should naturally be encompassed by the technical scope of the present disclosure.

E: ADDITIONAL STATEMENTS

For example, the following configurations are understood from the above-described embodiments and examples.

A liquid ejecting head of an aspect (Aspect 1) of the present disclosure includes a plurality of first nozzles that eject a liquid in an ejecting direction, a first nozzle forming surface in which openings of the plurality of first nozzles are formed, a first surface being adjacent to the first nozzle forming surface in view of an opposite direction to the ejecting direction and provided in the ejecting direction relative to the first nozzle forming surface, and a first film member having water repellency on a surface directed to the ejecting direction, the first film member being detachably provided to the first surface in such a way as to expose the first nozzle forming surface in the ejecting direction. According to this aspect, the first surface to be provided with the first film member is located in the ejecting direction relative to the first nozzle forming surface. Thus, the first nozzle forming surface is less likely to be pressed at the time of wiping to wipe off the ink adhering to the first film member provided to the first surface. As a consequence, the wear of the first nozzle forming surface attributed to the wiping is suppressed. Moreover, since the first film member is detachably provided to the first surface, the water repellency of the first surface is ensured by replacing the first film member with a new film member even if the first film member wears out in the course of the wiping.

In a specific example (Aspect 2) of Aspect 1, the first surface is hydrophilic. Thus, the adhesion strength between the first surface and the first film member is improved.

In a specific example (Aspect 3) of Aspect 1 or 2, the first surface surrounds the first nozzle forming surface in view of the opposite direction to the ejecting direction, and the first film member is provided to the first surface and includes an opening that exposes the first nozzle forming surface in the ejecting direction. According to this aspect, the first surface provided with the first nozzle forming surface is configured to surround the first nozzle forming surface. Thus, the sealing performance between the cap and a surface of the first film member is improved when the cap is brought into contact with the surface of the first film member to seal the nozzles and the sealed nozzles are cleaned in the maintenance operation for the liquid ejecting head.

In a specific example (Aspect 4) of any one of Aspects 1 to 3, a distance between the first nozzle forming surface and the first surface in the ejecting direction is larger than a thickness of the first film member. According to this aspect, the first nozzle forming surface is even less likely to be pressed at the time of wiping to wipe off the ink adhering to the first film member provided to the first surface. As a consequence, the wear of the first nozzle forming surface attributed to the wiping is effectively suppressed.

In a specific example (Aspect 5) of any one of Aspects 1 to 4, the liquid ejecting head further includes a projection being adjacent to the first surface in view of the opposite direction to the ejecting direction and projecting in the ejecting direction, and the first film member comes into contact with at least part of the projection. According to this aspect, the first film member is positioned at the side surface of the projection. Thus, high-accuracy alignment is not required when providing the first film member to the first surface.

In a specific example (Aspect 6) of Aspect 5, the projection includes a water-repellent surface directed to the ejecting direction, and a surface of the first film member is provided in the ejecting direction relative to the water-repellent surface. According to this aspect, adhesion of the ink to the surface of the projection is suppressed. Moreover, since the surface of the first film member is located in the ejecting direction relative to the surface of the projection, the water-repellent film formed on the surface of the projection is kept from detachment at the time of wiping to wipe off the ink adhering to the first film member provided to the first surface.

In a specific example (Aspect 7) of Aspect 6, the first film member further includes a pressure sensitive adhesive provided on an opposite surface to the surface and configured to establish fixation to the first surface. Thus, the first film member can be easily peeled off the first surface.

In a specific example (Aspect 8) of any one of Aspects 1 to 7, the first nozzle forming surface and the first surface are surfaces formed on a nozzle plate.

In a specific example (Aspect 9) of any one of Aspects 1 to 8, the liquid ejecting head further includes a plurality of second nozzles that eject a liquid in the ejecting direction, a second nozzle forming surface in which openings of the plurality of second nozzles are formed, a second surface being adjacent to the second nozzle forming surface in view of the opposite direction to the ejecting direction and provided in the ejecting direction relative to the second nozzle forming surface, and a second film member having water repellency on a surface directed to the ejecting direction, the second film member being detachably provided to the second surface in such a way as to expose the second nozzle forming surface in the ejecting direction. According to this aspect, even when the degrees of deterioration are difference among the plurality of film members, only the film member that deteriorates more out of the plurality of film members can be replaced selectively. Thus, it is possible to ensure the water repellency of the first surface at lower cost than the case of replacing the entire first film member.

In a specific example (Aspect 10) of Aspect 9, the plurality of first nozzles eject a first liquid, and the plurality of second nozzles eject a second liquid.

In a specific example (Aspect 11) of Aspect 10, an average grain size of particles contained in the first liquid is larger than an average grain size of particles contained in the second liquid. According to this aspect, when the film members correspond to the nozzles that eject the liquids containing particles in the different average grain sizes, respectively, the water repellency of the first surface is ensured only by replacing the film member that corresponds to the nozzles which eject the liquid that is more likely to deteriorate the first film member while withholding replacement of the film member which is yet to deteriorate. Thus, it is possible to ensure the water repellency of the first surface at low cost. The liquid that is more likely to deteriorate the first film member is a liquid that contains the particles having the larger average grain size than the average grain size of the particles contained in the liquid that is less likely to deteriorate the first film member.

In a specific example (Aspect 12) of Aspect 10 or 11, Mohs hardness of particles contained in the first liquid is higher than Mohs hardness of particles contained in the second liquid. According to this aspect, when the film members correspond to the nozzles that eject the liquids containing particles having different values of the Mohs hardness, respectively, the water repellency of the first surface is ensured only by replacing the film member that corresponds to the nozzles which eject the liquid that is more likely to deteriorate the first film member while withholding replacement of the film member which is yet to deteriorate. Thus, it is possible to ensure the water repellency of the first surface at low cost. The liquid that is more likely to deteriorate the first film member is a liquid that contains the particles having the Mohs hardness higher than the Mohs hardness of the particles contained in the liquid that is less likely to deteriorate the first film member.

In a specific example (Aspect 13) of any one of Aspects 10 to 12, the first liquid is a white ink and the second liquid is an ink different from the white ink. According to this aspect, the water repellency of the first surface is ensured only by replacing the film member that corresponds to the nozzles which eject the liquid that is more likely to deteriorate the first film member. Thus, it is possible to ensure the water repellency of the first surface at low cost. The liquid that is more likely to deteriorate the first film member is the white ink, for example.

In a specific example (Aspect 14) of any one of Aspects 10 to 13, the first liquid contains an inorganic pigment and the second liquid does not contain an inorganic pigment. According to this aspect, the water repellency of the first surface is ensured only by replacing the film member that corresponds to the nozzles which eject the liquid that is more likely to deteriorate the first film member. Thus, it is possible to ensure the water repellency of the first surface at low cost. The liquid that is more likely to deteriorate the first film member is the liquid containing the inorganic pigment, for example.

In a specific example (Aspect 15) of any one of Aspects 10 to 13, the first liquid is a pigment ink and the second liquid is a dye ink.

A liquid ejecting apparatus according to an aspect (Aspect 16) of the present disclosure includes the liquid ejecting head according to any one of Aspects 9 to 15, and a wiping member that wipes an ejecting surface of the liquid ejecting head.

In a specific example (Aspect 17) of Aspect 16, the wiping member wipes a surface of the first film member and a surface of the second film member along a direction orthogonal to a direction of arrangement of the first nozzle forming surface and the second nozzle forming surface. According to this aspect, the wiping member is kept from wiping the film member corresponding to the nozzles which eject the ink that is less likely to deteriorate the film member while retaining the ink that is more likely to deteriorate the first film member. Thus, it is possible to delay the progress of deterioration of the film member corresponding to the nozzles which eject the ink that is less likely to deteriorate the first film member.

In a specific example (Aspect 18) of Aspect 16, the wiping member wipes a surface of the first film member and a surface of the second film member along a direction from the second nozzle forming surface to the first nozzle forming surface. According to this aspect, when the film member corresponding to the nozzles which eject the liquid that is more likely to deteriorate the first film member is wiped after wiping the film member corresponding to the nozzles which eject the liquid that is less likely to deteriorate the first film member, the wiping member is kept from wiping the film member corresponding to the nozzles which eject the liquid that is less likely to deteriorate the film member while retaining the liquid that is more likely to deteriorate the first film member. Thus, it is possible to delay the progress of deterioration of the film member corresponding to the nozzles which eject the ink that is less likely to deteriorate the first film member.

What is claimed is:

1. A liquid ejecting head comprising:

a first nozzles configured to eject a liquid in an ejecting direction;

a first nozzle forming surface in which openings of the first nozzles are formed;

a first surface being adjacent to the first nozzle forming surface when viewed in an opposite direction to the ejecting direction and provided in the ejecting direction relative to the first nozzle forming surface; and a first film member having water repellency on a surface directed to the ejecting direction, the first film member being detachably provided to the first surface by including a pressure sensitive adhesive on an opposite surface of the first film member that is opposite from the surface and is configured to fix to the first surface in such a way as to expose the first nozzle forming surface in the ejecting direction and in such a way that the first film member is detached from the first surface without damaging the first surface and leaving any the pressure sensitive adhesive on the first surface, a projection being adjacent to the first surface without any gap between an inner peripheral surface of the projection and the first surface when viewed in the opposite direction to the ejecting direction and projecting in the ejecting direction, wherein an outer peripheral surface of the first film member contacts with at least part of the inner peripheral surface of the projection when viewed in the opposite direction to the ejecting direction.

2. The liquid ejecting head according to claim 1, wherein the first surface is hydrophilic, and the first nozzle forming surface is water-repellent.

3. The liquid ejecting head according to claim 1, wherein the first surface surrounds the first nozzle forming surface when viewed in the opposite direction to the ejecting direction, and the first film member is provided to the first surface and includes an opening that exposes the first nozzle forming surface in the ejecting direction.

4. The liquid ejecting head according to claim 1, wherein a distance between the first nozzle forming surface and the first surface in the ejecting direction is larger than a thickness of the first film member.

5. The liquid ejecting head according to claim 1, wherein the projection includes a water-repellent surface directed to the ejecting direction, and a surface of the first film member is provided in the ejecting direction relative to the water-repellent surface.

6. The liquid ejecting head according to claim 1, wherein the first nozzle forming surface and the first surface are formed on a nozzle plate.

7. The liquid ejecting head according to claim 1, further comprising:

a second nozzles configured to eject a liquid in the ejecting direction;

a second nozzle forming surface in which openings of the second nozzles are formed;

a second surface being adjacent to the second nozzle forming surface when viewed in the opposite direction to the ejecting direction and provided in the ejecting direction relative to the second nozzle forming surface; and a second film member having water repellency on a surface directed to the ejecting direction, the second film member being detachably provided to the second surface in such a way as to expose the second nozzle forming surface in the ejecting direction.

8. The liquid ejecting head according to claim 7, wherein the first nozzles eject a first liquid, and the second nozzles eject a second liquid.

9. The liquid ejecting head according to claim 8, wherein an average grain size of particles contained in the first liquid is larger than an average grain size of particles contained in the second liquid.

10. The liquid ejecting head according to claim 8, wherein Mohs hardness of particles contained in the first liquid is higher than Mohs hardness of particles contained in the second liquid.

11. The liquid ejecting head according to claim 8, wherein the first liquid is a white ink, and the second liquid is an ink different from the white ink.

12. The liquid ejecting head according to claim 8, wherein the first liquid contains an inorganic pigment, and the second liquid does not contain an inorganic pigment.

13. The liquid ejecting head according to claim 8, wherein the first liquid is a pigment ink, and the second liquid is a dye ink.

14. A liquid ejecting apparatus comprising;

the liquid ejecting head according to claim 7, and a wiping member configured to wipe an ejecting surface of the liquid ejecting head.

15. The liquid ejecting apparatus according to claim 14, wherein the wiping member wipes a surface of the first film member and a surface of the second film member along a direction orthogonal to a direction of arrangement of the first nozzle forming surface and the second nozzle forming surface.

16. The liquid ejecting apparatus according to claim 14, wherein the wiping member wipes a surface of the first film member and a surface of the second film member along a direction from the second nozzle forming surface to the first nozzle forming surface.

17. A liquid ejecting apparatus comprising the liquid ejecting head according to claim 1.

18. The liquid ejecting head according to claim 1, wherein the pressure adhesive has an adhesive power in a range from about 0.1 N/cm to about 20 N/cm so the first film member is detachably provided to the first surface.

19. The liquid ejecting head according to claim 1, wherein an entirety of the outer peripheral surface of the first film member contacts with an entirety of the inner peripheral surface of the projection when viewed in the opposite direction to the ejecting direction.

* * * * *